United States Patent [19]

Haslam

[11] Patent Number: 4,948,188

[45] Date of Patent: Aug. 14, 1990

[54] SNOW SHOVEL

[76] Inventor: Stephen D. Haslam, 3910 W. Erie Ave. Apt. B-1, Lorain, Ohio 44053

[21] Appl. No.: 421,822

[22] Filed: Oct. 16, 1989

[51] Int. Cl.[5] ..... A01B 1/22; E01H 5/02

[52] U.S. Cl. ..... 294/54.5; 37/285; 294/50.8

[58] Field of Search ..... 294/49–51, 294/53.5, 54.5, 56, 57, 59; 15/236.01, 236.05, 236.06; 37/196, 265, 266, 284, 285; 56/400.01, 400.04–400.07, 400.12, 400.17; 111/92, 106, 107

[56] References Cited

U.S. PATENT DOCUMENTS

| | | | |
|---|---|---|---|
| 1,761,503 | 6/1930 | Tonhardt | 294/50.8 |
| 2,409,778 | 10/1946 | McCaffrey | 294/50.8 X |
| 2,728,598 | 12/1955 | Szillage | 294/54.5 X |
| 3,177,026 | 4/1965 | Cowan | 294/54.5 |
| 3,804,451 | 4/1974 | Burke | 294/54.5 X |
| 4,103,383 | 8/1978 | Martin | 37/265 X |
| 4,489,969 | 12/1984 | Merry | 294/50.8 |
| 4,786,095 | 11/1988 | Dumont | 294/51 |

FOREIGN PATENT DOCUMENTS

| | | | |
|---|---|---|---|
| 753073 | 10/1933 | France | 37/266 |

*Primary Examiner*—Johnny D. Cherry
*Attorney, Agent, or Firm*—Donald A. Bergquist

[57] ABSTRACT

A snow shovel is presented that requires no bending by the operator and no lifting of snow. The snow-moving elements are blades mounted on pivotally connected elongate handles such that the blades, which are in contact with the ground through a snow layer, are driven apart by a downward and outward motion of the handgrips; this blade motion moves away snow in the path of each of the two blades as they separate. At least a portion of each blade is deflectably mounted to remain in an upright position as sweep motion proceeds, thus no snow accumulates atop the blade.

20 Claims, 3 Drawing Sheets

SNOW SHOVEL

INTRODUCTION

This invention relates to snow shovels. In particular, this invention relates to a snow shovel designed principally for use by those individuals who, for various reasons including precarious health, should not bend and should not lift snow. The shovel of this invention accomodates such restrictions by pushing snow aside to clear a path while the operator stands upright, rather than by requiring any bending or any lifting of snow on a shovel.

BACKGROUND

Snow shovels have been created in many configurations over the years. A flat board was nailed to a pole to form the simplest wooden shovels; the flat board blade later was replaced with a piece of sheet metal; the sheet metal was then made thinner with reinforcements added or pressed into the form of the blade of the shovel. The blade was later modified by changing the attachment to the pole, even to the point of creating a snow plow, thereby requiring no lifting of snow; by putting a more durable edge on a softer metal blade; by putting a rubber edge on the blade to better scrape irregular surfaces. Additional handles and other attachments have been added to either reduce the need for the operator to bend or to reduce the amount of lifting effort to be expended.

In the present invention, the operator lifts no snow and does little or no bending. Certainly, no bending with a shovelful of snow is required with the present invention.

BRIEF SUMMARY OF THE INVENTION

The snow shovel of the present invention comprises two identical flat blades of a suitable size mounted on elongated handles that are pivotably attached at a location intermediate their ends to allow them to operated in scissors fashion. In the best mode, an angled handgrip portion is provided at the handle end opposite the blade. Also in the best mode, the blade is hinged along a line that is substantially perpendicular to the axis of the handle, the hinge being biased to maintain the distal portion of the blade substantially parallel to the handle.

In use, the shovel is held vertically with the blades down and touching the ground through the layer of snow and the handles extending upward therefrom in a closed position wherein the handgrips are close to one another. Force is exerted upon the handgrips in a downward and outward direction, thereby separating them while pressing the blades to the ground as they sweep away from one another along the surface of the ground. The blades thereby push the snow to the side in each direction, leaving clear of snow the increasing space between the blades. In the best mode, the blades flex to maintain a near vertical orientation to more efficiently move the snow. Thus, the snow is not lifted, but pushed to either side as the blades move outward.

Thus, it is an object of this invention to provide a snow moving device in which two blades that are initially disposed adjacent and substantially parallel to one another and substantially in edgewise contact with the ground, are moved by manual means away from one another, thereby to move snow in their paths.

It is a further object of this invention to provide manual means to move such blades, which means comprise pivotably joined elongate handles.

It is a further object of this invention to provide such a snow moving device wherein each of said blades is pivotably connected to one of said handles, the pivot means being biased to keep the blade axially aligned with said handle or coplanar with the axis of said handle.

It is a further object of this invention to provide such a snow moving device wherein said blades are each in two sections, a proximal section fixedly attached to said handle and a distal section pivotably attached to said proximal section along a pivot axis substantially perpendicular to said handle and biased to keep the distal and proximal sections coplanar.

It is a further object of this invention to provide such a snow moving device wherein the ground-contacting blades include a pliable polymeric or elastomeric edge.

DETAILED DESCRIPTION OF THE INVENTION

This invention will best be understood by referring to the attached drawings, wherein the same part is identified throughout by the same reference number.

Figure 1:
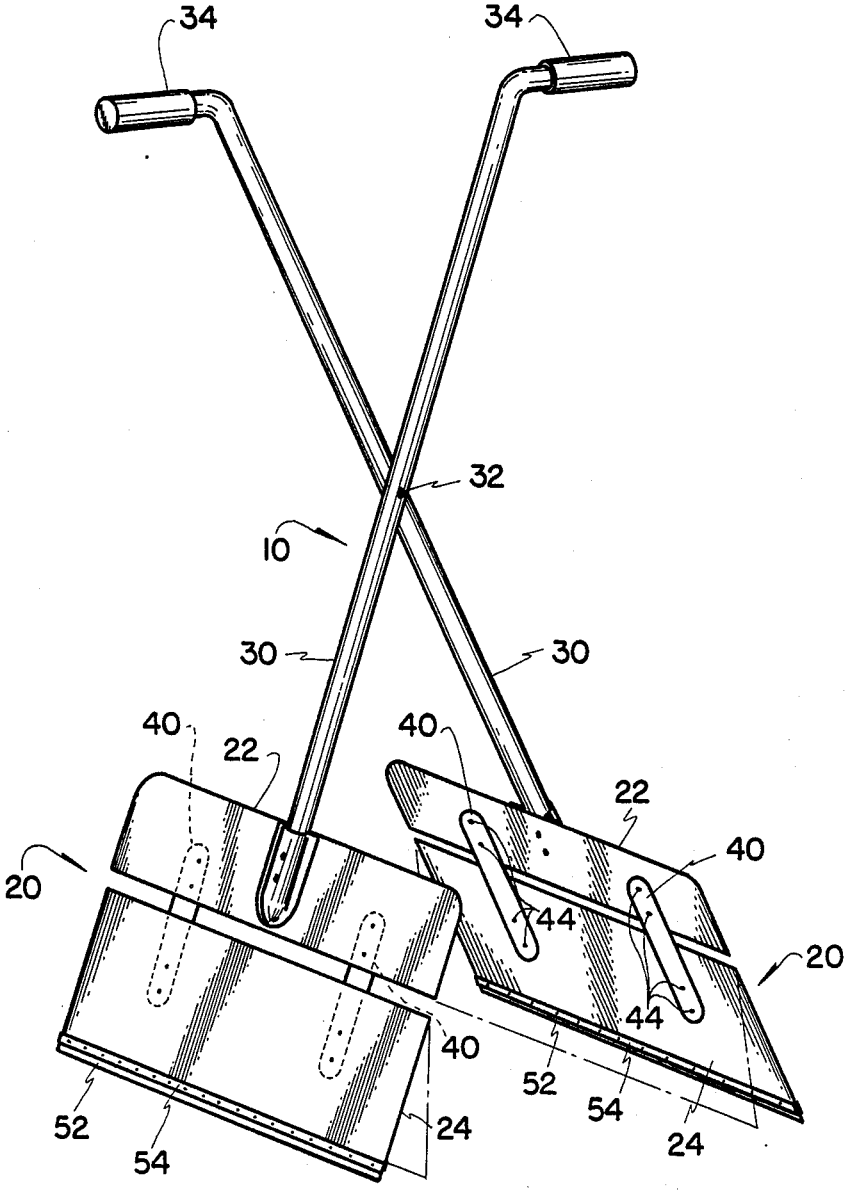
FIG. 1 is a perspective view of the invention in one mode thereof.

FIG. 1 shows the snow shovel 10 of this invention. The figure shows each blade 20 comprising a proximal section 22 and a distal section 24, the latter being pivotably attached to the former, defining a first pivot axis. In the figure, the proximal section of each blade is fixedly attached to the end of one of the elongate handles 30, which are pivotably attached at a point 32 intermediate their ends, thereby defining a second pivot axis. The other end of each elongate handle 30 is shown to terminate with a handgrip 34, which may be a bent extension of the handle 32, as shown.

In FIG. 1, the pivotable attachment of the two sections of each blade is a bit unusual from normal pivotable attachments. In this case, the attachment is by means of spring steel straps 40 only, which straps are fixedly attached to each blade section by fasteners 44. By selecting during manufacture, the placement of the fasteners 44, especially those on the distal blade section, the flexibility of the connection between the blades can be altered. Also of note in this means of connecting the blade sections is that there is no pivot pin present. Indeed, in this example, the first pivot axis moves relative to the blade sections, depending upon the amount of deflection of the distal blade section from the rest position of the springs and also upon the placement of the fasteners.

The bottom edge of the distal section of each blade may be lifted with a durable edge 52 of a material different from the material of which the blades 20 are made.

It would be desirable that the blades 20 be made of lightweight aluminum. Whereas aluminum may bend at the edge or wear at an excessive rate, the edge material 52 may also add rigidity to the edge of the mounting means 54 for the edge material may add such rigidity to the region of the edge. An edge material of steel may be used, for instance, to reduce the wear and stiffen the edge of the blade. An edge material of an elastomeric material may produce quieter operation of the shovel and greater compliance with the ground surface being cleared, thereby producing a cleaner sweep of the snow from the ground, but the stiffening would then be accomplished by the attachment means 54. These edges features may be found on snow shovels and plows currently marketed, but they may also be advantageously applied to the present invention. Indeed, the best mode of the present invention includes an elastomeric edge feature.

Figure 2:
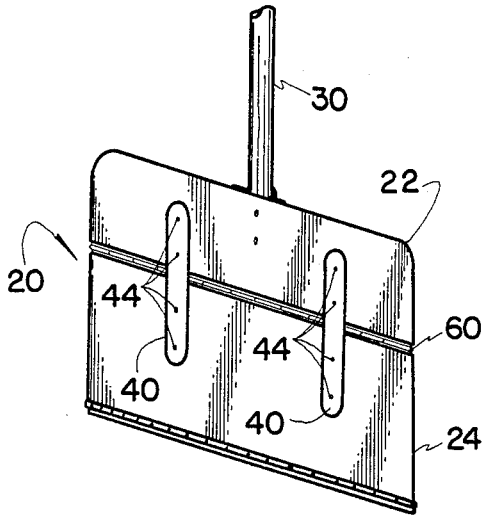
FIG. 2 is a perspective view of an alternative embodiment of the blade portion of the invention.

In a more normal pivotable attachment, as is shown as the best mode of this invention in FIG. 2, a pivot pin 60 is present, to which the distal blade section and the proximal blade section are pivotably attached. In this example, the first pivot axis is thereby fixed. The flexibility of this pivotable attachment is a function of the nature of the spring steel strap 40 and the placement of the fasteners 44.

Figure 3:
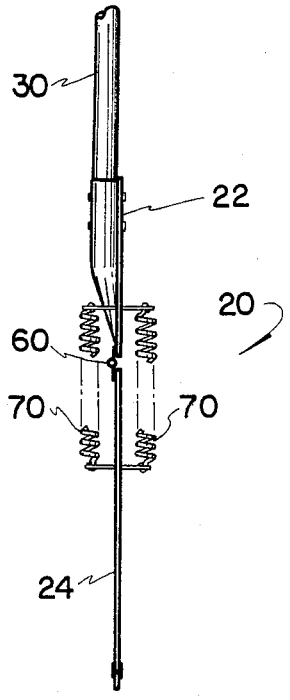
FIG. 3 is a side view of yet another alternative embodiment of the blade portion of the invention.

An alternative to the use of flat springs 40 of FIG. 1 and FIG. 2 is shown in FIG. 3 and involves the use of one or more elastic members 70 on each side of the blade 20 and linking the distal section 24 of the blade and the proximal section 22 of the blade on either side of a pivot pin 60 that fixes the first pivot axis. These elastic members may be coil springs or they may be elastic bands such as rubber bands. Indeed, the first working model was constructed using rubber bands in this manner. The elastic members must be balanced to keep the distal section 24 of the blade coplanar with the proximal section 22 when in the rest position, and they must impart sufficient rigidity to the pivotable joint to be effective in supporting the distal section 24 when the shovel is in use clearing snow. Rubber bands cut from automobile inner tubes may be sufficiently strong and have the necessary elasticity. Elastic members similar to so-called "bungi cords" may be preferable. Applicant defers this detail to the design engineer.

Figure 4A:
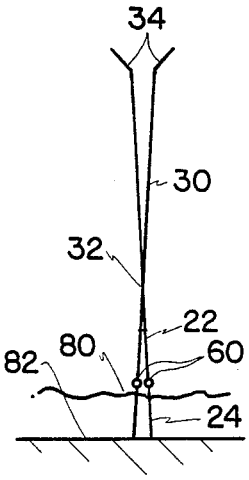
FIG. 4, parts a, b, and c, shows a schematic view of the operation of one blade of the invention.
Figure 4B:
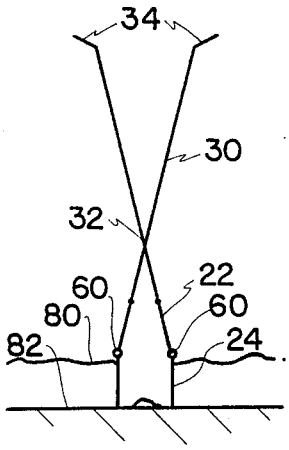
Figure 4C:
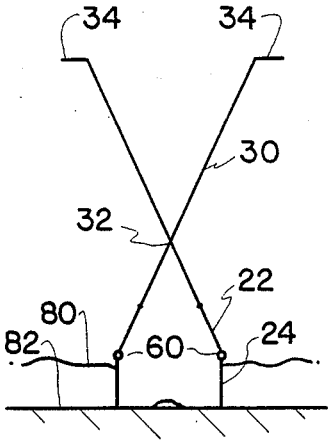

FIG. 4 illustrates the sequence of actions as the shovel is in use. In FIG. 4*a*, the shovel in closed position has been lowered in a vertical position through the snow 80 to the ground 82. Force is exerted on the handgrips 34 in opposite outward and downward directions to positions as shown in FIG. 4*b* and 4*c*, thereby forcing apart the handgrips and, by means of the pivotable joint 32 in the handles 30, also forcing apart the blades 20 while they are simultaneously forced downward to maintain contact with the ground 82. The mass of the snow being moved and the friction of the contact with the ground cause the distal section 24 of each blade to deflect from its normal position coplanar with the corresponding proximal section 22 thereof as the proximal section departs from the vertical towards the horizontal, as shown in FIG. 4*c*. This deflection of the distal blade section tends to keep the distal blade sections 24 nearly vertical as they are forced apart. As the distal blade sections are forced apart, moving in opposite directions substantially normal to their respective surfaces, they push the snow from their path without the need for the operator to bend, stoop, or lift any snow. Upon completion of one stroke, the shovel of this invention is lifted, closed, advanced in a direction parallel to the bottom edge of its blade, and placed into the snow again, as in FIG. 4*a* to repeat the sweeping action.

Figure 6:
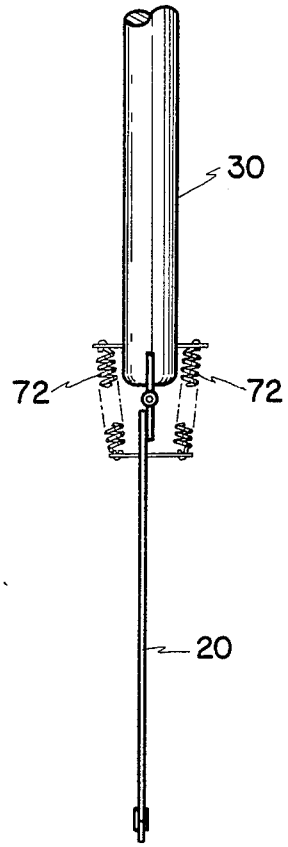
FIG. 6 illustrates another alternate embodiment of the invention, wherein a unitary blade is featured.
Figure 5:
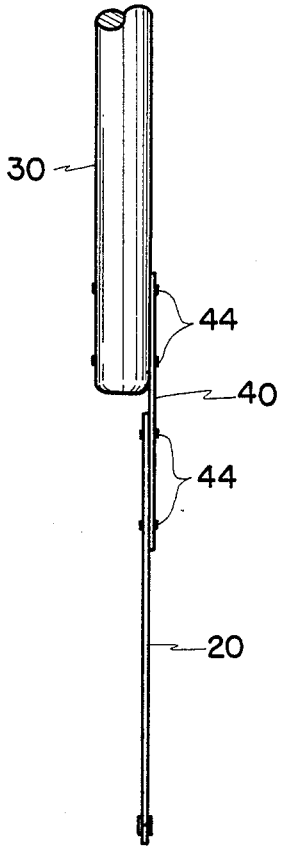
FIG. 5 illustrates an alternate embodiment of the invention, wherein a unitary blade is featured.

As is illustrated in FIG. 5, it is a part of this invention to have such a snow shovel wherein the blade 20 is of unitary construction, not in two sections, but where each blade 20 is pivotably attached to a respective handle 30 with biasing means to urge each unitary blade coplanar with the axis of the respective handle. In this mode, strip type springs 40 could be attached along the shaft of the handle 30 and on the blade, as shown in FIG. 5. Alternatively, tension means 72 could be attached on each side of the blade and attached to corresponding sides of the shaft of the handle 30, as is shown in FIG. 6. The suggesting of these embodiments shall not be considered restricting, but merely as suggested variations on the invention.

In an alternative mode of use, one or preferably both blades of the shovel of this invention may be swept across the surface of the ground in a motion similar to the motion imparted to a broom. The deflection of the blade portion in contact with the ground makes this shovel especially amenable to such use. In this use, snow is pushed first to one side, then to the other. This mode may be especially effective with very light snow.

Having thus described his invention, including a totally functional specific example thereof, applicant desires to include within the scope of his invention those improvements that would be immediately obvious to one skilled in the art, some, but not all of which have been referred to herein. Applicant desires the breadth of his invention to be limited only by the scope of the claims appended hereto.

I claim:

1. A manually operated snow shovel comprising a first substantially flat blade and a second blade substantially identical thereto and operating in opposition thereto, said blades disposed at the ends of mutually crossing pivoted elongate handles, each said handle having a long axis thereof, and wherein each said blade comprises a blade section proximal a corresponding said handle and a blade section distal said corresponding handle, said distal blade section being pivotably connected to said proximal blade section so as to have a pivot axis that is substantially perpendicular to the long axis of said handle and said distal blade section is biased by a biasing means that urges it to be a coplanar with said proximal blade section.

2. The snow shovel of claim 1 wherein said biasing means comprises a flat strip spring.

3. The shovel of claim 1 wherein said biasing means comprises a flat strip spring that is the only means of connecting said distal blade section with said proximal blade section, such that said pivot axis may move relative to said proximal blade section.

4. The snow shovel of claim 1 wherein said pivotable connection of the blades includes a pivot pin pivotably engaging each of said blade sections in a hingelike manner.

5. The snow shovel of claim 4 wherein said biasing means comprises a first tension means disposed on one side of and substantially perpendicular to said pivot pin and interconnecting that side of said distal blade section with that side of said proximal blade section, and a second tension means disposed on the opposite side of and substantially perpendicular to said pivot pin and interconnecting that side of said distal blade section with that side of said proximal blade section.

6. The snow shovel of claim 5 wherein said tension means comprise coil springs.

7. The snow shovel of claim 5 wherein said tension means comprise bands of elastomeric material.

8. The snow shovel of claim 1 wherein said distal blade section has a ground-contacting edge that comprises a straight edge of a material different from the material of said distal blade section, said straight edge being attached to said distal blade section.

9. The snow shovel of claim 8 wherein said straight edge is of an elastomeric material.

10. The snow shovel of claim 8 wherein said straight edge is of a metal harder than that of which said blade is made.

11. A manually operated snow shovel comprising a first substantially flat blade and a second blade substantially identical thereto and operating in opposition thereto, said blades disposed at the ends of mutually crossing pivoted elongate handles, each said handle having a long axis thereof, each said blade being pivotably connected to said handle respective thereto so as to have a pivot axis that is substantially perpendicular to the long axis of said handle and each said blade is biased by a biasing means that urges it to be coplanar with the long axis of said handle respective thereto.

12. The snow of claim 11 wherein said biasing means comprises a flat strip.

13. The snow shovel of claim 11 wherein said biasing means comprises a flat strip spring that is the only means of connecting said blade with said handle, such that said pivot axis may move relative to said handle.

14. The snow shovel of claim 11 wherein said pivotable connection of the blade to the handle includes a pivot pin pivotably engaging said blade and said handle in a hingelike manner.

15. The snow shovel claim 14 wherein said biasing means comprises a first tension means disposed on one side of and substantially perpendicular to said pivot pin and interconnecting that side of said blade with that side of said handle, and a second tension means disposed on the opposite side of and substantially perpendicular to said pivot pin and interconnecting that side of said blade with that side of said handle.

16. The snow shovel of claim 15 wherein said tension means comprise coil springs.

17. The snow shovel of claim 15 wherein said tension means comprise bands of elastomeric material.

18. The snow shovel of claim 11 wherein each said blade has a ground-contacting edge that comprises a straight edge of a material different from the material of said blade, said straight edge being attached to said blade.

19. The snow shovel of claim 18 wherein said straight edge is of an elastomeric material.

20. The snow shovel of claim 18 wherein said straight edge is of a metal harder than that of which said blade is made.

* * * * *